US006808463B1

(12) United States Patent
Stockwell, III

(10) Patent No.: US 6,808,463 B1
(45) Date of Patent: Oct. 26, 2004

(54) SOCCER GOAL ASSEMBLY

(76) Inventor: John A. Stockwell, III, 3902 McKinley Rd., China, MI (US) 48054

( * ) Notice: Subject to any disclaimer, the term of this patent is extended or adjusted under 35 U.S.C. 154(b) by 62 days.

(21) Appl. No.: 10/356,807

(22) Filed: Feb. 3, 2003

(51) Int. Cl.[7] ..... A63B 69/00
(52) U.S. Cl. ..... 473/478; 473/476
(58) Field of Search ..... 473/478, 476, 473/490, 492, 494, 493

(56) References Cited

U.S. PATENT DOCUMENTS

| | | | | | |
|---|---|---|---|---|---|
| 2,077,343 | A | * | 4/1937 | Oakes et al. | 473/478 |
| 3,642,282 | A | | 2/1972 | Frischman | |
| 4,127,272 | A | | 11/1978 | Pennell | |
| 4,842,284 | A | * | 6/1989 | Rushing et al. | 273/395 |
| 5,086,875 | A | * | 2/1992 | Shreve, III | 182/152 |
| 5,186,469 | A | | 2/1993 | Terris | |
| 5,372,368 | A | | 12/1994 | Pavonetti | |
| D356,353 | S | | 3/1995 | Broyles et al. | |
| 5,431,411 | A | * | 7/1995 | Padilla | |
| 5,539,957 | A | | 7/1996 | Schmidt | |
| 5,542,679 | A | * | 8/1996 | Caso | 473/175 |
| 5,556,104 | A | * | 9/1996 | Guillen, Jr. | 473/435 |
| 5,599,024 | A | * | 2/1997 | Acuff et al. | 473/478 |
| 5,951,415 | A | * | 9/1999 | Gates et al. | 473/478 |
| 6,558,279 | B1 | * | 5/2003 | Goldwitz | 473/478 |

* cited by examiner

*Primary Examiner*—Gregory Vidovich
*Assistant Examiner*—M. Chambers

(57) ABSTRACT

A soccer goal assembly for allowing the bottom of the net member to be raised off the ground so that the groundskeeper can maintain the grounds upon which the net member rests. The soccer goal assembly includes frame anchor members being adapted to be imbedded in a ground; and also includes a frame assembly being removably attached to the frame anchor members and including first and second tubular members being hingedly attached to one another; and further includes a net member being attached to the first and second tubular members; and also includes fastening members for fastening the first and second tubular members together in a folded position.

7 Claims, 4 Drawing Sheets

SOCCER GOAL ASSEMBLY

BACKGROUND OF THE INVENTION

1. Field of the Invention

The present invention relates to soccer goal kits and more particularly pertains to a new soccer goal assembly for allowing the bottom of the net member to be raised off the ground so that the groundskeeper can maintain the grounds upon which the net member rests.

2. Description of the Prior Art

The use of soccer goal kits is known in the prior art. More specifically, soccer goal kits heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,127,272; 5,539,957; 5,186,469; 3,642,282; 5,372,368; and Des. 356,353.

While these devices fulfill their respective, particular objectives and requirements, the aforementioned patents do not disclose a new soccer goal assembly. The prior art includes frames and nets being attached to the frames.

SUMMARY OF THE INVENTION

The general purpose of the present invention, which will be described subsequently in greater detail, is to provide a new soccer goal assembly which has many of the advantages of the soccer goal kits mentioned heretofore and many novel features that result in a new soccer goal assembly which is not anticipated, rendered obvious, suggested, or even implied by any of the prior art soccer goal kits, either alone or in any combination thereof. The present invention includes frame anchor members being adapted to be imbedded in a ground; and also includes a frame assembly being removably attached to the frame anchor members and including first and second tubular members being hingedly attached to one another; and further includes a net member being attached to the first and second tubular members; and also includes fastening members for fastening the first and second tubular members together in a folded position. None of the prior art includes the combination of the elements of the present invention.

There has thus been outlined, rather broadly, the more important features of the soccer goal assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new soccer goal assembly which has many of the advantages of the soccer goal kits mentioned heretofore and many novel features that result in a new soccer goal assembly which is not anticipated, rendered obvious, suggested, or even implied by any of the prior art soccer goal kits, either alone or in any combination thereof.

Still another object of the present invention is to provide a new soccer goal assembly for allowing the bottom of the net member to be raised off the ground so that the groundskeeper can maintain the grounds upon which the net member rests.

Still yet another object of the present invention is to provide a new soccer goal assembly that is easy and convenient to set up and use.

Even still another object of the present invention is to provide a new soccer goal assembly that can be secured in the ground but can also be easily removed and folded up for easy storage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
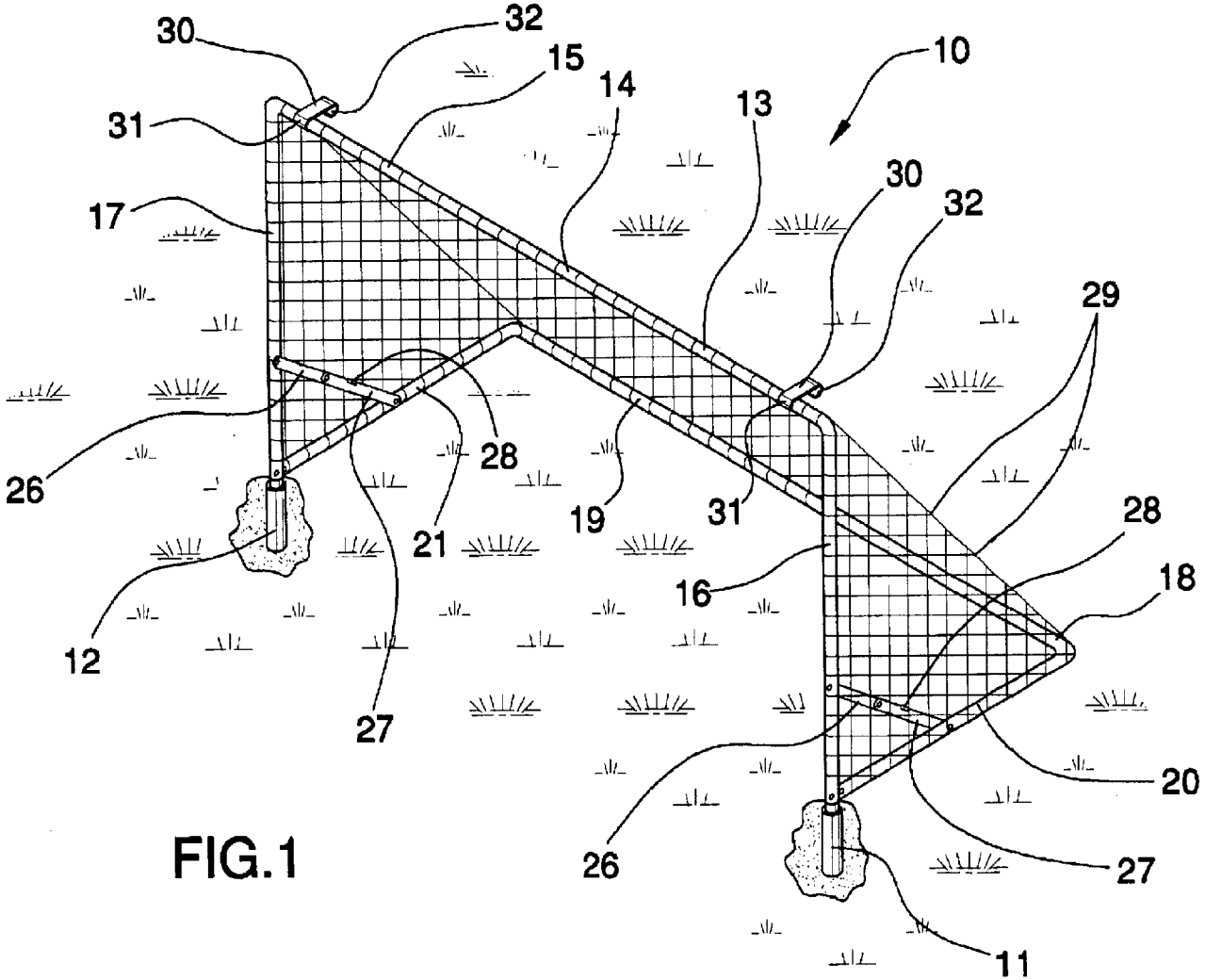
FIG. 1 is a perspective view of a new soccer goal assembly according to the present invention.
Figure 2:
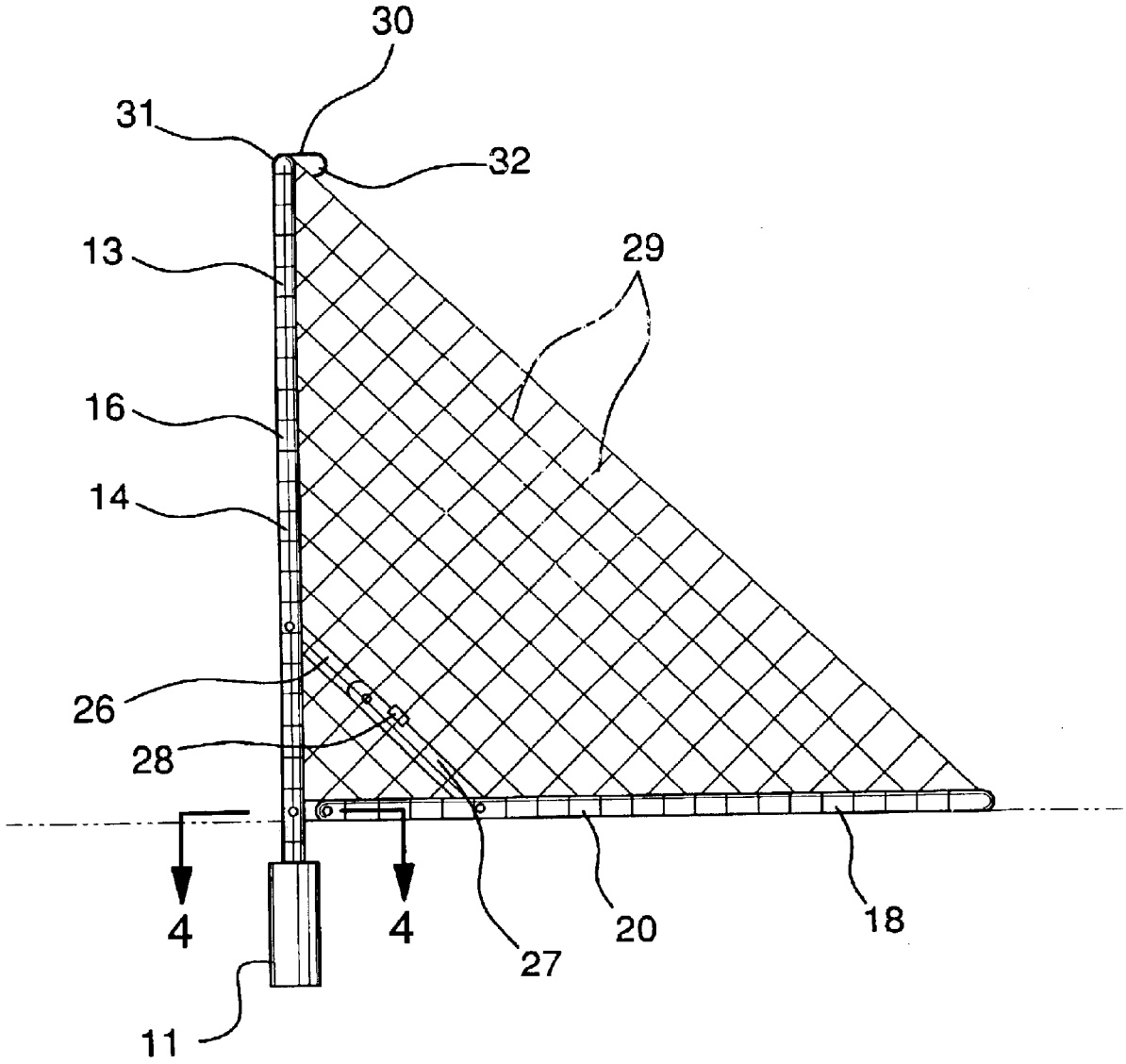
FIG. 2 is a side elevational view of the present invention.
Figure 3:
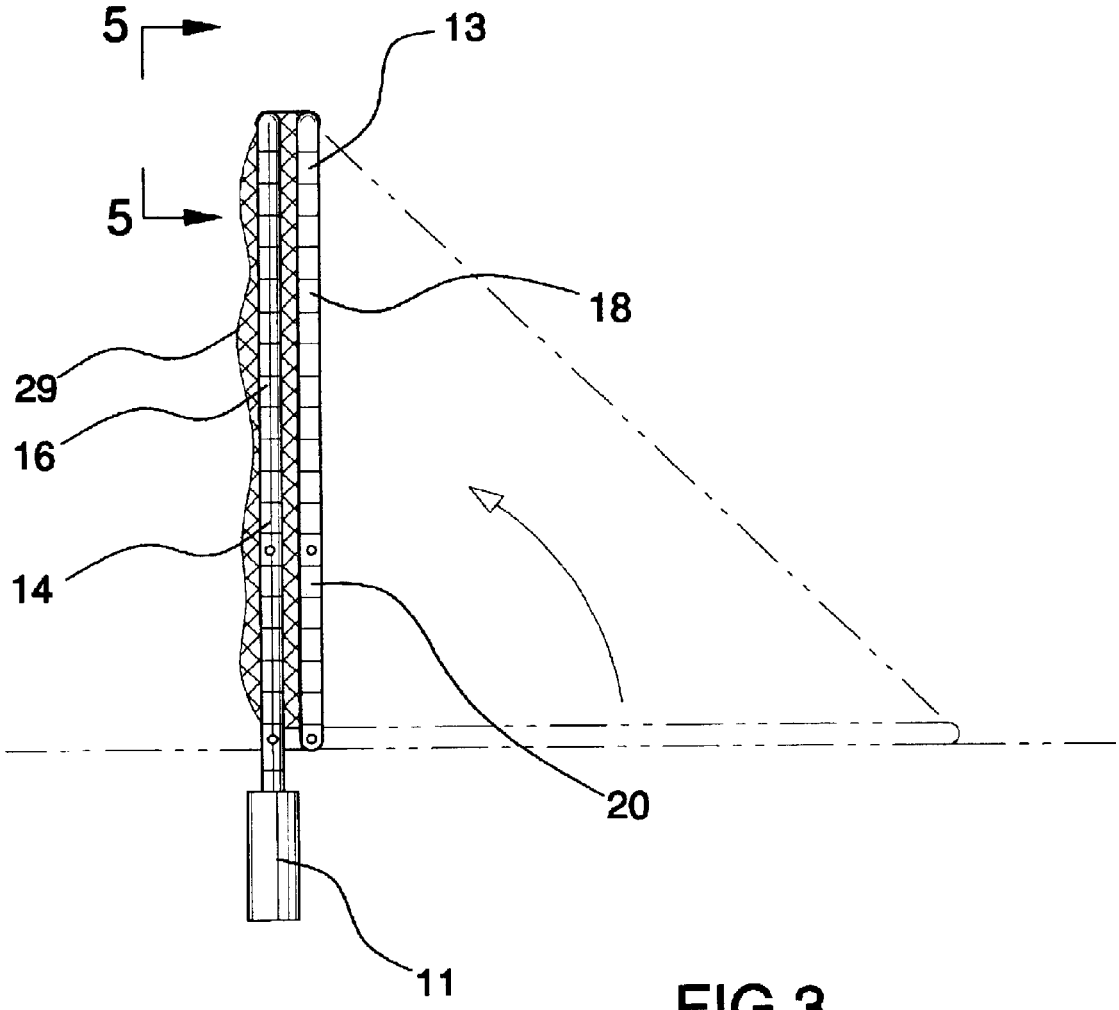
FIG. 3 is another side elevational view of the present invention in a folded position.
Figure 4:
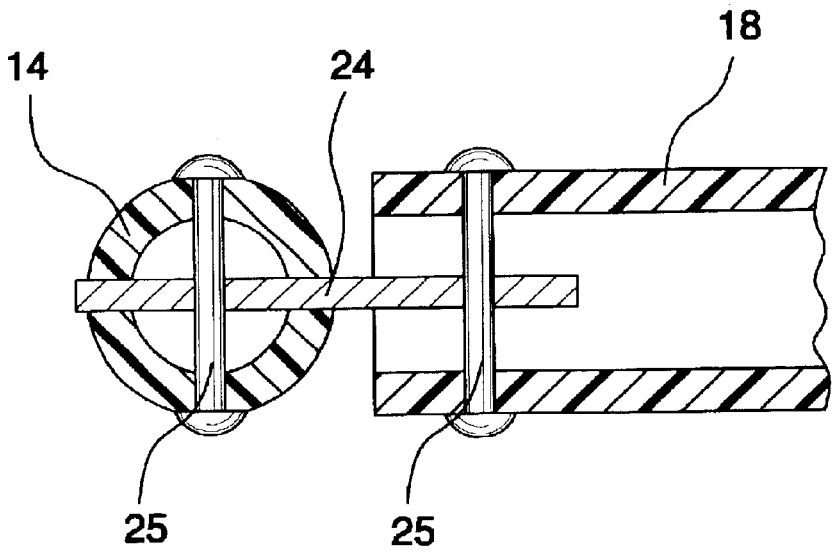
FIG. 4 is a detailed partial cross-sectional view of the present invention.
Figure 5:
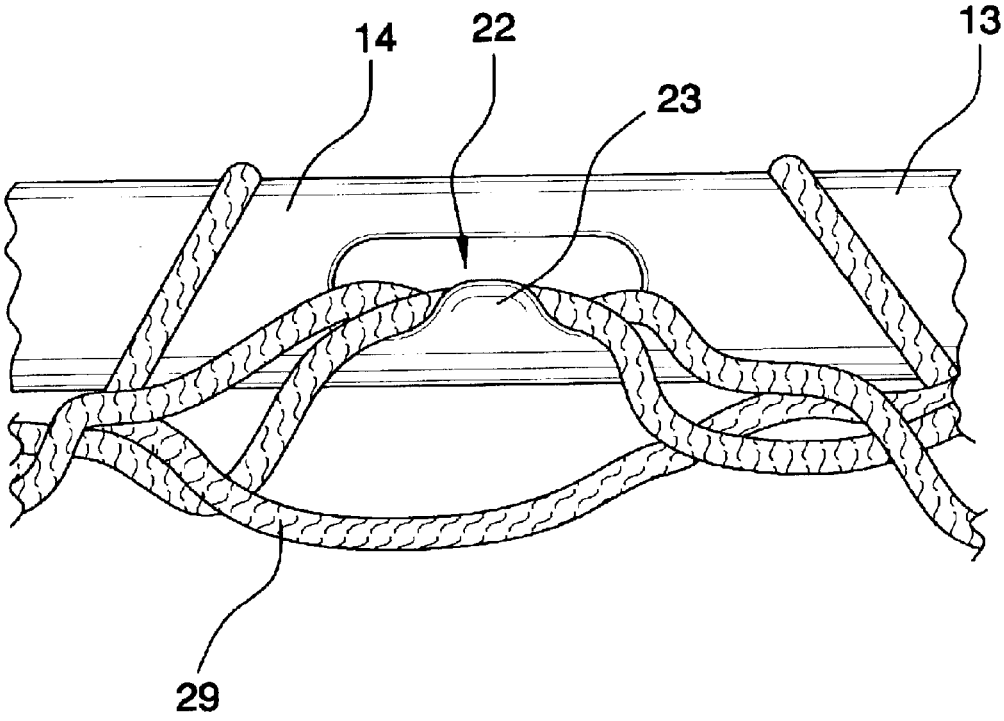
FIG. 5 is a detailed partial side elevational view of the present invention.

With reference now to the drawings, and in particular to FIGS. 1 through 5 thereof, a new soccer goal assembly embodying the principles and concepts of the present invention and generally designated by the reference numeral 10 will be described.

As best illustrated in FIGS. 1 through 5, the soccer goal assembly 10 generally comprises frame anchor members 11,12 being adapted to be imbedded in a ground. The frame anchor members 11,12 are cylindrical sockets being imbedded in the ground.

A frame assembly 13 is removably attached to the frame anchor members 11,12 and include first and second tubular members 14,18 being hingedly attached to one another. The first tubular member 14 includes an elongate top portion 15, and also includes elongate side portions 16,17 being angled generally perpendicular to the elongate top portion 15 and having ends which are securely and removably inserted in the cylindrical sockets 11,12. The second tubular member 18 includes an elongate main portion 19, and also includes elongate side portions 20,21 being angled generally perpendicular to the elongate main portion 19 and having ends which are hingedly connected to the elongate side portions 16,17 of the first tubular member 15. The frame assembly 13 further includes pivot shafts 24 interconnecting the second tubular member 18 to the first tubular member 14 and upon which the first and second tubular members 14,18 are hingedly attached with fasteners 25. The fasteners 25 are disposed through the elongate side portions 16,17,20,21 of the first and second tubular members 14,18 and through the pivot shafts 24. The frame assembly 13 further includes collapsible support members 26–28 being securely attached to the first and second tubular members 14,18 for bracing the first and second tubular members 14,18 apart from one another. Each of the collapsible support members 26–28 includes a first linkage 26 having a first end being pivotally and securely attached to a respective elongate side portion 16,17 of the first tubular member 14, and also includes a second linkage 27 having a first end being pivotally and securely attached to a respective elongate side portion 20,21 of the second tubular member 18 and having a second end which is pivotally and securely attached to a second end of the first linkage 26, and further includes a clip member 28 being securely attached to the first linkage 26 and being engageable to the second linkage 27 for securing the first and second linkages 26,27 in extended longitudinal alignment with one another. The frame assembly 13 also includes longitudinal slots 22 being spacedly disposed through the first and second tubular members 14,18 with the first and second tubular members 14,18 having nodular portions 23 being integrally disposed along edges defining the longitudinal slots 22 and being extended inwardly of the longitudinal slots 22.

A net member 29 is securely attached to the first and second tubular members 14,18. The net member 29 is a mesh screen having a perimeter which is extended about the first and second tubular members 14,18 and through the longitudinal slots 22 and about the nodular portions 23.

The soccer goal assembly 10 further comprises fastening members 30 for fastening the first and second tubular members 14,18 together in a folded position. Each of the fastener members 30 has first and second hook-shaped end portions 31,32. The first hook-shaped end portion 31 is engaged about a portion of the elongate top portion 15 of the first tubular member 14, and the second hook-shaped end portion 32 is engageable about the elongate main portion 19 of the second tubular member 18 to hold the first and second tubular members 14,18 together in a folded position.

In use, the user secures the ends of the elongate side portions 16,17 of the first tubular member 14 in the cylindrical sockets 11,12, and unhooks the second tubular member 18 from the first tubular member 14 and extends the second tubular member 18 upon the ground with the clip members 28 engaging the second linkages 27 with the first and second linkages 26,27 being longitudinally aligned. To maintain the ground around the net member 29, the user simply raises the second tubular member 18 and hooks it to the first tubular member 14 using the fastening members 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the soccer goal assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A soccer goal assembly comprising:

frame anchor members being adapted to be imbedded in a ground;

a frame assembly being removably attached to said frame anchor members and including first and second tubular members being hingedly attached to one another, said frame anchor members being cylindrical sockets being imbedded in the ground, said first tubular member including an elongate top portion, and also including elongate side portions being angled generally perpendicular to said elongate top portion and having ends which are securely and removably inserted in said cylindrical sockets, said second tubular member including an elongate main portion, and also including elongate side portions being angled generally perpendicular to said elongate main portion and having ends which are hingedly connected to said elongate side portions of said first tubular member, said frame assembly further including pivot shafts interconnecting said second tubular member to said first tubular member and upon which said first and second tubular members being freely hingedly attached with fasteners, each said fastener being respectively disposed through said elongate side portions of said first and second tubular members and through respective ends of said pivot shafts;

a net member being attached to said first and second tubular members; and fastening members for fastening said first and second tubular members together in a folded position.

2. The soccer goal assembly as described in claim 1, wherein said frame assembly further includes collapsible support members being attached to said first and second tubular members for bracing said first and second tubular members apart from one another.

3. The soccer goal assembly as described in claim 2, wherein each of said collapsible support members includes a first linkage having a first end being pivotally attached to a respective said elongate side portion of said first tubular member, and also includes a second linkage having a first end being pivotally attached to a respective said elongate side portion of said second tubular member and having a second end which is pivotally attached to a second end of said first linkage, and further includes a clip member being attached to said first linkage and being engageable to said second linkage for securing said first and second linkages in extended longitudinal alignment with one another.

4. The soccer goal assembly as described in claim 3, wherein said frame assembly also includes longitudinal slots being spacedly disposed through said first and second tubular members, said first and second tubular members having nodular portions being disposed along edges defining said longitudinal slots and being extended inwardly of said longitudinal slots.

5. The soccer goal assembly as described in claim 4, wherein said net member is a mesh screen having a perimeter which is extended about said first and second tubular members and through said longitudinal slots and about said nodular portions.

6. The soccer goal assembly as described in claim 5, wherein each of said fastener members has first and second hook-shaped end portions, said first hook-shaped end portion being engaged about a portion of said elongate top portion of said first tubular member, said second hook-shaped end portion being engageable about said elongate main portion of said second tubular member to hold said first and second tubular members together in a folded position.

7. A soccer goal assembly comprising:

frame anchor members being adapted to be imbedded in a ground, said frame anchor members being cylindrical sockets;

a frame assembly being removably attached to said frame anchor members and including first and second tubular members being hingedly attached to one another, said first tubular member including an elongate top portion, and also including elongate side portions being angled generally perpendicular to said elongate top portion and having ends which are securely and removably inserted in said cylindrical sockets, said second tubular member including an elongate main portion, and also including elongate side portions being angled generally perpendicular to said elongate main portion and having ends which are hingedly connected to said elongate side portions of said first tubular member, said frame assembly further including pivot shafts interconnecting said second tubular member to said first tubular member and upon which said first and second tubular members are freely hingedly attached with fasteners, each said fastener being respectively disposed through said elongate side portions of said first and second tubular members and through respective ends of said pivot shafts assembly further including collapsible support members being attached to said first and second tubular members for bracing said first and second tubular members apart from one another, each of said collapsible support members including a first linkage having a first end being pivotally attached to a respective said elongate side portion of said first tubular member, and also including a second linkage having a first end being pivotally attached to a respective said elongate side portion of said second tubular member and having a second end which is pivotally attached to a second end of said first linkage, and further including a clip member being attached to said first linkage and being engageable to said second linkage for securing said first and second linkages in extended longitudinal alignment with one another, said frame assembly also including longitudinal slots being spacedly disposed through said first and second tubular members, said first and second tubular members having nodular portions being disposed along edges defining said longitudinal slots and being extended inwardly of said longitudinal slots;

a net member being attached to said first and second tubular members, said net member being a mesh screen having a perimeter which is extended about said first and second tubular members and through said longitudinal slots and about said nodular portions; and fastening members for fastening said first and second tubular members together in a folded position, each of said fastener members having first and second hook-shaped end portions, said first hook-shaped end portion being engaged about a portion of said elongate top portion of said first tubular member, said second hook-shaped end portion being engageable about said elongate main portion of said second tubular member to hold said first and second tubular members together in a folded position.

* * * * *